United States Patent [19]

Huffman

[11] 4,377,260

[45] Mar. 22, 1983

[54] ROLLER MILL DRIVE

[76] Inventor: Jon W. Huffman, 1610 Arboles Dr., Glendale, Calif. 91207

[21] Appl. No.: 200,318

[22] Filed: Oct. 24, 1980

[51] Int. Cl.[3] ..... B02C 4/42

[52] U.S. Cl. ..... 241/101.2; 241/143; 241/227; 474/86

[58] Field of Search ..... 241/101.2, 143, 159, 241/227, 230, 221; 474/84, 86, 87, 88, 148; 34/121; 100/172, 176; 72/449

[56] References Cited

U.S. PATENT DOCUMENTS

| | | | |
|---|---|---|---|
| 385,420 | 7/1888 | Mawhood | 241/143 |
| 446,407 | 2/1891 | Masters . | |
| 904,582 | 11/1908 | Wallace . | |
| 1,185,477 | 5/1916 | Cannon . | |
| 2,162,624 | 6/1939 | Logue . | |
| 2,195,105 | 3/1940 | Watt . | |
| 2,549,501 | 4/1951 | McClelland | 241/143 |
| 2,966,746 | 1/1961 | Mellbin . | |
| 3,132,739 | 5/1964 | Jakobsson et al. . | |
| 3,965,764 | 6/1976 | Avramidis . | |

FOREIGN PATENT DOCUMENTS 903602 8/1962 United Kingdom .

*Primary Examiner*—Mark Rosenbaum

*Attorney, Agent, or Firm*—Christie, Parker & Hale

[57] ABSTRACT

A roller mill has two pairs of parallel rolls, each pair comprising fast and slow rolls driven in opposite directions. In a flour mill, wheat is ground between each pair of rolls to produce flour. A drive motor drives a first one of the fast rolls through a V-belt drive. The driven fast roll drives the second fast roll through a 1:1 endless chain drive. The slow rolls are driven in an opposite direction and at a slower speed than the fast rolls by a serpentine chain drive engaged with a slow roll, a fast roll, and the other slow roll, in that order. Both chain drives are arranged next to each other at one end of the roller mill and are housed in a common oil bath housing containing oil for lubricating the drive chains. The chain drive eliminates the need for a lineshaft and drive pulleys, as well as a jackshaft and idler pulleys, and associated bearings and guarding that are normally used with a prior art belt-driven roller mill.

40 Claims, 6 Drawing Figures

ROLLER MILL DRIVE

BACKGROUND OF THE INVENTION

1. Field of the Invention

This invention relates generally to roller mills, and more particularly to an improved roller mill drive. More specifically, the invention relates to an improved drive for a "double roller mill" having two pairs of parallel rolls in which the rolls in each pair are driven in opposite directions and at different speeds. The rolls driven at the higher speed are referred to as "fast" rolls, and the rolls driven at the lower speed are referred to as "slow" rolls.

2. Description of the Prior Art

A roller mill is used to reduce the particle size of a substance by grinding it between two steel rolls. In flour mills, wheat is fed to a roller mill which grinds the material to produce flour.

Probably most flour mills in this country today use a double roller mill for making flour. Each double roller mill, which is also referred to as a "roll stand", is commonly powered by a belt drive system that has been used in flour mills since approximately the early 19th century. This belt drive system is used on roller mills manufactured by Nordyke and Marmon Co., for example; and a similar belt drive system is shown in U.S. Pat. No. 2,549,501 to McClelland. This prior belt drive system includes two large flat belts. One belt turns the two fast rolls in one direction, while the other belt turns the two slow rolls in the opposite direction.

This belt drive includes separate pulleys on the fast rolls, and an idler pulley on a jackshaft, or tunnel shaft, that runs through the base of the roll stand. The drive belt for the fast rolls engages one fast roll pulley, the idler pulley on the jackshaft, and the other fast roll pulley, in that order. The fast roll drive belt is driven by a large drive motor on a lower floor of the flour mill below the roll stand. The drive motor powers a large drive pulley on a lineshaft that runs through the lower floor of the mill. The fast roll drive belt is engaged with the drive pulley on the lineshaft and then runs upwardly to the next floor of the mill where it engages the two fast roll pulleys and the idler pulley on the jackshaft. A second belt drive at the opposite end of the roll stand powers the two slow rolls. The second belt engages separate large pulleys on the slow rolls and a pulley on the jackshaft for transferring power from the fast roll drive, at one end of the roll stand, to the slow roll drive at the other end of the roll stand.

Flour mills continue to use this type of roller mill today, in part, because of the tremendous capital cost involved in replacing it with new roller mills. For example, a typical flour mill has a large number of these roll stands arranged in rows on one floor of the flour mill, while the drive motor and the lineshaft for each row are installed in the next floor below each row of roll stands. The roll stands in each row receive power from separate drive belts engaged with corresponding drive pulleys on the lineshaft. The drive belts all extend from the lineshaft in the lower floor to the roll stands on the next floor. A jackshaft tunnels through each machine, and separate belts for the fast and slow roll drives of each roll stand are engaged with the jackshaft.

Such an arrangement of roll stands requires extensive guarding around the drive motor, the lineshaft, and the various drive belts in the lower floor of the mill, and around the drive belts on opposite ends of each roll stand on the next floor. The guarding is required for safety to protect workers from the working parts of the machines.

Because of such guarding, it is a costly and timeconsuming job to frequently clean the flour dust that constantly collects inside the guarded regions of the mill. Frequent cleaning is required by various health ordinances to maintain sanitary conditions in the flour mill. The guarding must be removed to gain access for cleaning, and the entire row of roll stands must be shut down during cleaning.

In addition to the large initial cost and maintenance costs required by the prior belt-driven roller mill, there are also other problems, such as belt slippage and buildup of static electricity, which are inherent in using large flat belt drives. Moreover, the roller mill drive must be capable of delivering a large amount of power to drive both pairs of rolls. To provide large power-handling capability requires wide belts with large diameter pulleys which, in turn, occupy a large amount of space in the mill.

This invention provides an improved roller mill drive that avoids many of the disadvantages of the prior belt-driven roller mill drive described above.

SUMMARY OF THE INVENTION

Briefly, my improved roller mill drive powers a roller mill having a first pair of adjacent rolls and a second pair of adjacent rolls. An endless chain drive, which connects one roll in the first pair with one roll in the second pair, is operative for rotating both rolls in unison. A separate serpentine chain drive is connected with one of the rolls with which the endless chain drive is connected. The serpentine chain drive is also connected with those rolls in the first pair and the second pair that are not connected with the endless chain drive. The serpentine chain drive is operative for rotating the rolls with which it is connected in unison. The endless chain drive and the serpentine chain drive cooperate to rotate the first pair of rolls in opposite directions and at a speed differential while also rotating the second pair of rolls in opposite directions and at a speed differential.

In one embodiment of the invention, each pair of rolls has a fast roll and a slow roll. The endless chain rotates both fast rolls, and the serpentine chain drive rotates the slow rolls while obtaining a reversal of direction from one of the fast rolls for rotating each slow roll in a direction opposite to the direction of rotation of its corresponding fast roll.

The endless chain drive and the serpentine chain drive can be arranged at one end of the roller mill and housed in an oil bath contained in a common housing.

My improved roller mill drive avoids the need for large flat drive belts, a lineshaft, a jackshaft, and associated bearings and guarding necessary for the commonly used belt-driven roller mill drive described above. Other advantages also are provided by my improved roller mill drive; but it was surprising to discover that it also provides a substantial reduction in power consumption when compared with the prior art belt-driven roller mill drive.

These and other aspects of the invention will be more fully understood by referring to the following detailed description and the accompanying drawings.

DRAWINGS

DETAILED DESCRIPTION

Figure 1:
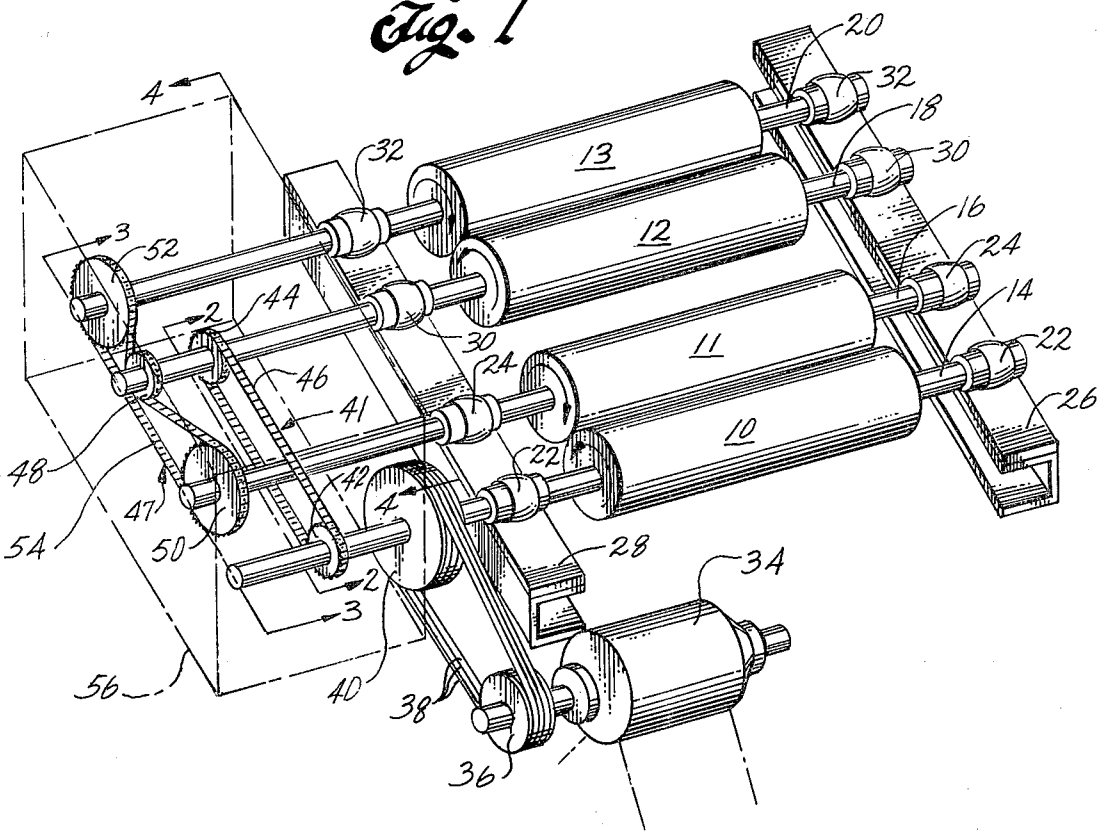
FIG. 1 is a perspective view showing an improved roller mill drive according to principles of this invention.

FIG. 1 illustrates a roller mill of the type used in flour mills. The roller mill, which is also referred to as a roll stand, includes two pairs of elongated cylindrical steel rolls. A first pair of rolls comprises a fast roll 10 and a slow roll 11, and a second pair of rolls comprises a fast roll 12 and a slow roll 13. The rolls are rotatable about corresponding parallel axes, and all four axes of rotation are in a common horizontal plane. One pair of rolls is separated from the other pair, while the working surfaces of the rolls in each pair are in contact. The fast and slow rolls are rotated in opposite directions, as illustrated by the arrows in FIG. 1. Wheat is fed between each pair of rotating fast and slow rolls to grind the wheat between the rolls to produce flour. Separate elongated feeder rolls (not shown) are mounted above each pair of rolls. The feeder rolls feed the grain between the fast and slow rolls. The fast and slow rolls are contained in the hollow interior of a roll stand housing which is not shown for simplicity.

The first pair of rolls are rotated about their axes by turning a fast roll shaft 14 and a slow roll shaft 16. Similarly, the second pair of rolls are rotated about their axes by turning a fast roll shaft 18 and a slow roll shaft 20. The fast and slow roll shafts 14 and 16 of the first pair of rolls are journaled in corresponding bearings 22 and 24 supported on right and left frame rails 26 and 28 at opposite ends of the rolls. The fast and slow roll shafts 18 and 20 of the second pair of rolls are journaled in corresponding bearings 30 and 32, also supported on the right and left frame rails.

Both pairs of rolls are powered by a drive motor 34 mounted adjacent one end of the roll stand. The drive motor powers one of the fast rolls through a V-belt drive. In the illustrated embodiment, the V-belt drive includes a multiple groove drive pulley 36 on the output shaft of the motor. Separate endless V-belts 38 are engaged, at one end of their travel, with the multiple groove drive pulley. The V-belts are separately engaged, at the opposite end of their travel, with multiple groove driven pulley 40 on the shaft 14 of the first fast roll 10. The V-belt drive alternatively could be engaged with the second fast roll shaft 18. The drive motor is driven at a relatively high speed, so the V-belt drive arrangement is used to reduce belt slippage when driving the fast roll. In one embodiment, the drive motor is a 20-horsepower squirrel-cage induction AC motor manufactured by Reliance Electric Co. The motor can be used to drive the rolls of a single roll stand, as shown; or the same motor, equipped with two output shafts, also can be used to drive the rolls in a pair of side-by-side roll stands.

The driven pulleys 40 are larger in diameter than the motor drive pulleys 36 to provide the necessary speed reduction for rotating the fast roll 10 at the desired rotational speed. In my roller mill drive, it is intended that a single drive motor, such as that described, be used for powering one roll stand, or, at the most, an adjacent pair of roll stands. This eliminates the need for a lineshaft, lineshaft drive pulleys, lineshaft drive belts, and associated bearings and guarding.

The roller mill drive also includes a differential chain drive arrangement for transferring power to the fast and slow rolls, so that each fast roll is rotated in a direction opposite to that of its corresponding slow roll, while also rotating each pair of fast and slow rolls at the desired differential speed. In the illustrated embodiment, the driven fast roll 10 powers the second fast roll 12 through a 1:1 endless chain drive 41, so that both fast rolls are rotated in the same direction and at the same speed. The chain drive 41 includes a small sprocket 42 on the first fast roll shaft 14 spaced outwardly from the V-belt drive, a small sprocket 44 of the same size on the second fast roll shaft 18, and an endless roller chain 46 engaged with the small sprockets on the two fast roll shafts. The endless chain drive essentially transfers power from one fast roll to the other, i.e., it rotates both fast rolls at the speed established by the V-belt drive.

A separate serpentine chain drive 47 simultaneously transfers power from one of the fast rolls to the slow rolls for rotating the slow rolls at a lower speed than the fast rolls and for rotating each slow roll in an opposite direction from its corresponding fast roll. The serpentine chain drive 47 includes a small sprocket 48 on the second fast roll shaft 18 spaced outwardly from the small sprocket 44 on the same shaft, a large sprocket 50 on the first slow roll shaft 16, a large sprocket 52 on the second slow roll shaft 20, and an endless roller chain 54 having its upper travel in a serpentine arrangement around the upper portion of the large sprocket 52, the underside of the small sprocket 48, and the upper portion of the large sprocket 50. The lower travel of the chain 54 passes horizontally from the underside of the large sprocket 50, under the small sprocket 48, without engaging the sprocket 48, to the underside of the large sprocket 52. In this serpentine chain drive arrangement, the small sprocket 48 transfers power from the fast roll endless chain drive to the serpentine chain drive and provides a reversal of direction that rotates the slow rolls in a direction opposite to the fast rolls. The large sprockets 50 and 52 are of the same size, so that the slow rolls are rotated at the same speed. In one embodiment, the smaller fast roll sprockets are 30-tooth sprockets, and the larger slow roll sprockets are 45-tooth sprockets for providing an approximately $1\frac{1}{2}$:1 speed differential, i.e., 540 rpm for the fast rolls and 360 rpm for the slow rolls.

In the illustrated chain drive arrangement, it is desirable to power one of the fast roll shafts from the output of the drive motor, rather than one of the slow roll shafts, because the driven pulley 40 of the V-belt drive can be sized small enough to not interfere with the nearby feeder roll, while providing the desired speed for the fast roll shaft. Moreover, the V-belt drive for transferring power from the motor to the chain drives is desirable, because the V-belt effectively handles the high-speed output of the motor and provides the desired speed reduction to the fast roll shaft. The 1:1 endless chain drive 41 is desirable, because it effectively powers both fast rolls at the desired speed, while the small sprockets 42 and 44 occupy only a small amount of space adjacent the roll stand. The small sprockets can be sized small enough to enable the larger sprockets 50 and 52 to be sized to properly reduce the speed of the slow rolls and still allow the large sprockets to operate without interference from an adjacent small sprocket. In one embodiment, there are about nine inches of spacing between the shafts of adjacent pairs of fast and slow rolls. The sprocket arrangement in the serpentine chain drive 47 is desirable, i.e., the larger sprockets are on the outside, and the small sprocket is near the middle, because it allows the chain 54 to pass under the small sprocket 48 without interference or without the need for additional idler sprockets. Although the illustrated serpentine chain drive is the desirable means for powering the fast and slow rolls, an additional idler sprocket (not shown) could be used in the serpentine chain drive adjacent the small sprocket, if desired, for increasing the angle of wrap around the small sprocket.

The chain drives can transfer the required amount of power at the desired roll speeds with reasonably small drive sprockets, resulting in an appreciable reduction of space requirements when compared with use of a corresponding flat belt drive. To achieve the same transfer of power at the required roll speeds with a flat belt drive requires wide belts and much larger pulleys, which occupy a substantially larger amount of space. This requires placement of belts and roll drive pulleys at both ends of the roll stand and requires use of a jackshaft connected between the drive pulleys at both ends of the roll stand.

The two separate chain drives are desired, as opposed to a single chain drive that operates both fast roll shafts and both slow roll shafts. To obtain the proper sprocket sizing for the required roll speeds, together with the required amount wrap around each sprocket would require an inordinate number of idler pulleys and/or use of a jackshaft, or its equivalent, if a single chain drive is used.

Figure 2:
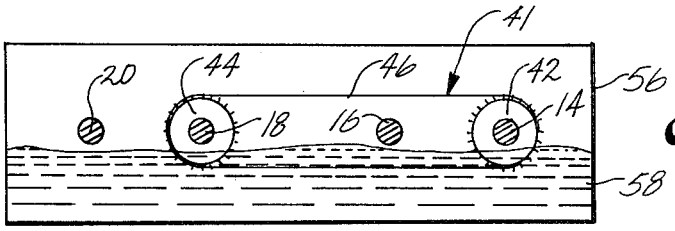
FIG. 2 is a semi-schematic elevation view, partly in cross-section, taken on line 2—2 of FIG. 1 and showing an endless chain drive in an oil bath.
Figure 3:
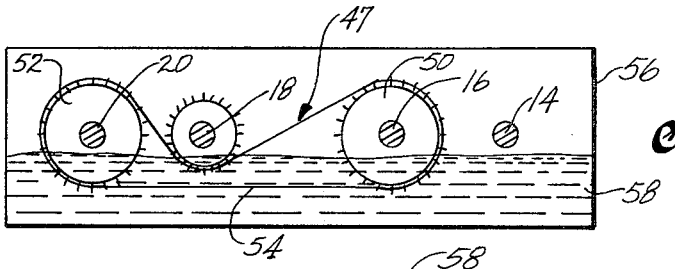
FIG. 3 is a semi-schematic elevation view, partly in cross-section, taken on line 3—3 of FIG. 1 and showing a serpentine chain drive in the same oil bath.

The endless chain drive 41 and the serpentine chain drive 47 are both contained in a common oil bath housing 56. As illustrated best in FIGS. 2 and 3, the oil bath housing contains an oil bath 58 in the lower portion of the housing for lubricating the lower portions of the endless chain drive (FIG. 2) and the serpentine chain drive (FIG. 3). Owing to the reasonably small amount of space required by the chain drives 41 and 47, the oil bath housing 56 only needs to be a small housing that is mounted at only one end of the roll stand. In addition to providing a means for lubricating both chain drives, the oil bath housing itself also provides the necessary guarding for the roll stand drive mechanism.

Figure 4:
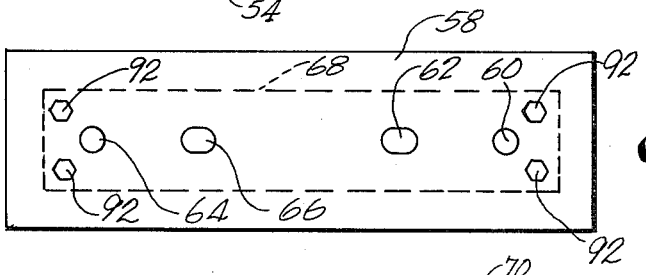
FIG. 4 is an elevation view taken on line 4—4 of FIG. 1 and showing a rear face of an oil bath housing.

The oil bath housing is shaped as a rectangular box in which the top and front sides are removable. Gaskets (not shown) seal the removable portions of the box. FIG. 4 illustrates four laterally spaced-apart holes in a rear face 58 of the oil bath housing for accommodating passage of the fast and slow roll shafts. The roll shafts terminate short of the front face of the oil bath housing, and therefore there are no similar holes in the front face of the housing. In the illustrated embodiment, the holes in the rear face include a circular outer hole 60 and an elongated inner hole 62 on one side of the housing for accommodating passage of the first fast and slow roll shafts 14 and 16, respectively. On the other side of the housing, a circular outer hole 64 and an elongated inner hole 66 accommodate passage of the second slow and fast roll shafts 20 and 18, respectively. The inner holes 62 and 66 are elongated to accommodate lateral motion of one roll shaft in each pair of rolls during grinding operations.

Figure 5:
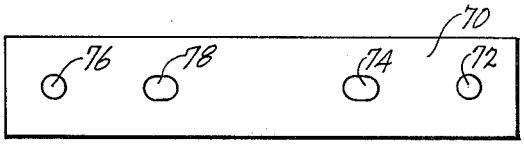
FIG. 5 is an elevation view showing one portion of a lubricant seal for the oil bath housing.
Figure 6:
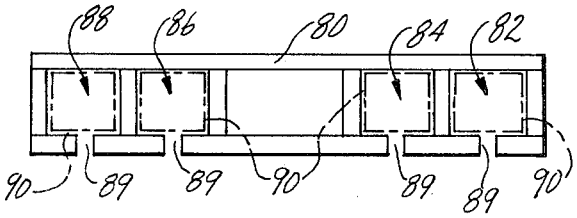
FIG. 6 is an elevation view showing another portion of the seal for the oil bath housing.

The holes in the rear face of the housing are sealed internally to prevent oil leakage to the exterior of the housing. FIGS. 5 and 6 illustrate component parts of a composite lubricant seal 68 through which the roll shafts pass. FIG. 5 illustrates an elongated rectangular sheet metal piece 70 having an outer circular hole 72 and an elongated inner hole 74 on one side, and a circular outer hole 76 and an elongated inner hole 78 on the other side for accommodating passage of the roll shafts in a manner similar to the rear face 58 of the oil bath housing.

FIG. 6 illustrates a spacer 80 made of a number of flat strap iron pieces that form a pair of rectangular openings 82 and 84 on one side and another pair of similar openings 86 and 88 on the other side for accommodating passage of the roll shafts. Small openings 89 for drainage are formed in the bottom of the four rectangular passages through the spacers.

The composite seal 68 also includes four separate pieces of rubber-backed nylon (shown in phantom lines at 90 in FIG. 6) in which each piece has a hole that closely fits around the exterior of a corresponding roll shaft. Each nylon/rubber piece is mounted around a corresponding shaft and positioned inside the oil bath housing adjacent the rear face of the housing for forming a first layer of the composite seal. The seal comprises a sandwich structure which next includes the sheet metal spacer 80 placed so the four nylon/rubber pieces fit inside the four rectangular openings in the spacer, as illustrated in FIG. 6. The sheet metal piece 70 overlies the spacer, and a second spacer is placed over the sheet metal piece, followed by four more of the nylon/rubber pieces 90 that fit inside the openings in the second spacer, followed by a second one of the sheet metal pieces 70. This entire sandwich structure is bolted to the rear face of the housing by bolts 92. Any oil that migrates along the roll shafts toward the openings in the rear face of the housing is picked up by the seal and can drain out through the openings 89 in the spacers and back into the oil bath.

A primary advantage of my chain drive over the prior belt-driven roller mill drive is its lower initial cost and lower maintenance cost. My roller mill drive eliminates the lineshaft and jackshaft of the prior art roller mill drive, along with many of their associated bearings and the large belt drives. This provides part of the reduction in initial cost for the roller mill, in addition to reduced cost for replacement parts.

Since the chain drive components of the roller mill drive are contained in the oil bath housing, which also serves as a guarding for the drive mechanism, the guarding typically required for the prior art belt-driven roller mill drive can also be eliminated. The prior guarding limits access to the machine for the operator and is time-consuming to remove and replace when cleaning. My roller mill drive provides much greater access to the roll stand for the operator, and does not require removal of guarding for cleaning.

By eliminating the flat drive belts used with the prior roller mill drive, there are no static electricity problems, as well as providing a more positive drive.

My chain-driven roller mill drive also has greatly reduced space requirements when compared with the prior belt-driven roller mill drive. Elimination of the lineshaft and the large drive motor that normally occupy the basement of a flour mill can make this entire space in the basement available for additional roller mills. In addition, roll stands equipped with my roller mill drive allow for closer spacing of roll stands within a given area, which also can increase the number of machines that can be used in a given space.

Since all machines in the prior art roller mill drive operate as a unit from a common lineshaft, the present invention also provides greater operating flexibility, in comparison, since each machine can be operated independently from its own power source, without the need for the lineshaft.

I have also discovered that the roller mill drive of this invention results in a significant reduction of power consumption, when compared with the prior belt-driven roller mill drive. An experimental chain-driven roller mill drive of this invention was installed on a roll stand in a flour mill, and power consumption measurements were taken from operation of the experimental roll stand and compared with power consumption measurements from other roll stands using the conventional belt-driven roller mill drive described above. The amount of power used by the roll stands was determined and converted to a measurement of power consumption in relation to the amount of roll surface per roll stand. On a north lineshaft running three roller mills with the conventional roller mill drive, there were 168 linear inches of roller surface, and measured power consumption was 0.3672 amps per inch. On a south lineshaft having five roller mills with 288 linear inches of roll surface, measured power consumption was 0.3352 amps per inch. On the experimental roller mill using a 30-inch roll with 60 linear inches of roll surface, the power consumption was 0.2249 amps per inch. This amount of power consumption was reduced to 0.1598 amps per inch when a 24-inch roll was substituted for the 30-inch roll. In all cases, the rolls were rotated at the same speeds with the same speed differentials, as well as other pertinent test conditions being similar. The magnitude of the reduction of power consumption was surprising, inasmuch as it amounted to at least a one-third reduction in power consumption. This provides such a substantial dollar savings in energy costs that it is economically feasible to replace the belt drive of the existing roller mills with the roller mill drive of this invention.

What is claimed is:

1. In a roller mill having a first pair of rolls and a second pair of rolls, an improved roller mill drive comprising:

an endless chain drive connected with a roll in said first pair and with a roll in said second pair and operative for rotating both rolls in unison; and a serpentine chain drive, separate from said endless chain drive, connected with one of the rolls with which said endless chain is connected and also connected with the roll in said first pair and with the roll in said second pair other than the rolls with which said endless chain is connected, the serpentine chain drive being operative for rotating the rolls with which it is connected in unison, the endless chain drive and the serpentine chain drive cooperating to rotate the first pair of rolls in opposite directions and at a speed differential, while also rotating the second pair of rolls in opposite directions and at a speed differential.

2. The improvement according to claim 1 including drive means for positively rotating at least one of the rolls in the first pair or the second pair for rotating both rolls in each pair through operation of the endless chain drive and the serpentine chain drive.

3. The improvement according to claim 2 in which the drive means comprises a drive motor, and speed reducing means transferring power from the drive motor to said positively driven roll at a reduced speed.

4. The improvement according to claim 1 including an oil bath housing containing an oil bath, and in which the endless chain drive and the serpentine chain drive are inside the housing for lubricating the chains with the oil bath.

5. The improvement according to claim 4 in which the first pair of rolls rotate on a corresponding pair of shafts; in which the second pair of rolls rotate on a corresponding pair of shafts; and in which both pairs of shafts extend into the oil bath housing.

6. The improvement according to claim 5 in which the shafts extend through a lubricant seal inside the oil bath housing, and in which the seal has means for picking up oil from the shaft and means for draining the picked up oil back into the oil bath.

7. The improvement according to claim 1 in which the endless chain drive rotates the rolls with which it is connected at the same speed and in the same direction, and in which the serpentine chain drive rotates the rolls that are not connected with the endless chain drive in the opposite direction and at a different speed from the rolls with which the endless chain drive is connected.

8. The improvement according to claim 1 including drive means for positively rotating one of the rolls with which the endless chain is connected.

9. The improvement according to claim 8, in which the endless chain drive includes a chain which is separate from the drive means and which is driven in response to operation of the drive means.

10. The improvement according to claim 9, in which the serpentine chain drive and the endless chain drive include separate chains connected to a common shaft of the same roll.

11. The improvement according to claim 1, in which the serpentine chain drive and the endless chain drive include separate chains connected to a common shaft of the same roll.

12. The improvement according to claim 11, including drive means for positively rotating one of the rolls with which the endless chain is connected.

13. The improvement according to claim 12, including an oil bath housing containing an oil bath; and in which the separate chains of the endless chain drive and the serpentine chain drive are inside the oil bath housing for lubricating the chains with the oil bath.

14. In a roller mill drive having two pairs of rolls comprising a first pair of adjacent fast and slow rolls and a second pair of adjacent fast and slow rolls, an improved roller mill drive comprising:

an endless chain drive connected with both of the fast rolls for rotating the fast rolls in unison;

a separate serpentine chain drive connected with one of the fast rolls and also connected with both of the slow rolls for rotating the slow rolls in unison at a slower speed than the fast rolls, while obtaining a reversal of rotational direction from the fast roll with which it is connected for rotating each slow roll in a direction opposite to the direction of rotation of its corresponding fast roll; and drive means for positively driving at least one of said rolls for operating the endless chain drive and the serpentine drive.

15. The improvement according to claim 14 in which the endless chain drive rotates the fast rolls in the same direction.

16. The improvement according to claim 15 in which the serpentine chain drive rotates the slow rolls in the same direction but opposite to the fast rolls.

17. The improvement according to claim 16 in which the drive means comprises a drive motor for positively driving one of the fast rolls.

18. The improvement according to claim 14 in which the drive means comprises a drive motor for positively driving one of the fast rolls.

19. The improvement according to claim 14 in which the drive means comprises a drive motor, and a belt drive connected from the drive motor to one of the fast rolls.

20. The improvement according to claim 14 in which the drive means comprises a drive motor, and speed reducing means transferring power from the drive motor to at least one of said rolls.

21. The improvement according to claim 14 including an oil bath housing containing an oil bath, and in which the endless chain drive and the serpentine chain drive are inside the oil bath housing for lubricating the chains with the oil bath.

22. The improvement according to claim 21 in which both fast rolls and both slow rolls rotate about their axes on corresponding roll shafts extending into the oil bath housing, and in which the endless chain drive and the serpentine chain drive are connected to the roll shafts inside the oil bath housing.

23. The improvement according to claim 22 in which the shafts extend through a lubricant seal inside the oil bath housing, and in which the seal has means for picking up oil from the shaft and means for draining the picked up oil back into the oil bath.

24. The improvement according to claim 14 in which the serpentine chain drive engages one slow roll, the fast roll, and the other slow roll, in that order.

25. The improvement according to claim 14, in which both fast rolls and both slow rolls rotate about their axes on corresponding roll shafts; and in which the serpentine chain drive is directly connected to the shaft of one slow roll, is directly connected to the shaft of one fast roll, and is directly connected to the shaft of the other slow roll, in that order.

26. The improvement according to claim 14, in which the endless chain drive includes a chain which is separate from the drive means and which is driven in response to operation of the drive means.

27. The improvement according to claim 26, in which the endless chain drive and the drive means are both directly connected to the same fast roll.

28. The improvement according to claim 27, in which the serpentine chain drive includes a chain directly connected to the fast roll to which the drive means is not connected.

29. The improvement according to claim 28, including an oil bath housing containing an oil bath; and in which the chains of the endless chain drive and the serpentine chain drive are inside the oil bath housing for lubricating the chains with the oil bath.

30. The improvement according to claim 14, in which the serpentine chain drive and the endless chain drive include separate chains each directly connected to a roll shaft of the same fast roll.

31. The improvement according to claim 30, including an oil bath housing containing an oil bath; and in which the chains of the endless chain drive and the serpentine chain drive are inside the oil bath housing for lubricating the chains with the oil bath.

32. A roller mill comprising:

a first pair of adjacent rolls;

a second pair of adjacent rolls;

a first chain drive connected with a roll in said first pair and with a roll in said second pair and operative for rotating both rolls in unison;

a second chain drive, separate from the first chain drive, connected with one of the rolls with which the first chain drive is connected and also connected with the roll in the first pair and with the roll in the second pair other than the rolls with which the first chain drive is connected, the second chain drive being operative for rotating the rolls with which it is connected in unison; and drive means for positively rotating at least one of the rolls in the first pair or the second pair for rotating both rolls in each pair through operation of the first and the second chain drives to rotate the first pair of rolls in opposite directions and at a speed differential, while also rotating the second pair of rolls in opposite directions and at a speed differential.

33. The roller mill according to claim 32, in which the first chain drive and the second chain drive include separate chains connected to a common shaft of the same roll.

34. The roller mill according to claim 33, in which the drive means is separate from both the first chain drive and the second chain drive and is positively connected with one of the rolls with which the first chain drive is connected.

35. The roller mill according to claim 33, including an oil bath housing containing an oil bath; and in which the chains of the first chain drive and the second chain drive are inside the housing for lubricating the chains with the oil bath.

36. A roller mill comprising:

a first pair of adjacent fast and slow rolls;

a second pair of adjacent fast and slow rolls, in which both fast rolls and both slow rolls rotate about their axes on corresponding roll shafts;

a first chain drive connected directly to the roll shafts of both fast rolls for rotating the fast rolls in unison;

a separate second chain drive connected directly to the roll shaft of one of the fast rolls and also connected directly to the roll shafts of both of the slow rolls for rotating the slow rolls in unison at a lower speed than the fast rolls, while obtaining a reversal of rotational direction from the fast roll with which it is connected for rotating each slow roll in a direction opposite to the direction of rotation of its corresponding fast roll; and drive means, separate from the first and second chain drives, directly connected to the roll shaft of at least one of said rolls for operating the first and second chain drives.

37. The roller mill according to claim 36, in which the second chain drive is connected to the shaft of one slow roll, to the shaft of one fast roll, and to the shaft of the other slow roll, in that order.

38. The roller mill according to claim 36, in which the first chain drive and the drive means are both directly connected to the roll shaft of the same fast roll.

39. The roller mill according to claim 38, in which the second chain drive is directly connected to the roll shaft of the fast roll to which the drive means is not connected.

40. The roller mill according to claim 39, including an oil bath housing containing an oil bath, and in which the first chain drive and the second chain drive are inside the oil bath housing for lubricating the chains with the oil bath.

* * * * *